United States Patent [19]

Sipley

[11] 4,423,831

[45] Jan. 3, 1984

[54] DROP-BOTTOM BOX

[75] Inventor: Richard L. Sipley, Cuyahoga Falls, Ohio

[73] Assignee: Apex Welding, Inc., Bedford, Ohio

[21] Appl. No.: 283,498

[22] Filed: Jul. 15, 1981

[51] Int. Cl.[3] ..... B67D 3/00

[52] U.S. Cl. ..... 222/185; 222/556; 292/218; 294/69 R

[58] Field of Search ..... 222/181, 185, 556, 505, 222/508, 517, 531, 533, 537; 294/69 R; 298/29–31, 35 R; 220/1.5, 315; 292/218, 125, 225; 105/238 R, 280; 414/422

[56] References Cited

U.S. PATENT DOCUMENTS

| | | | |
|---|---|---|---|
| 284,864 | 9/1883 | Laughlin et al. | 222/556 X |
| 2,678,742 | 5/1954 | Zorn | 414/422 |
| 2,836,454 | 5/1958 | Johansson | 294/69 R |
| 2,877,938 | 3/1959 | Cox | 298/30 X |
| 3,152,824 | 10/1964 | Bolling et al. | 294/69 R X |
| 3,719,296 | 3/1973 | Larson | 414/422 |

FOREIGN PATENT DOCUMENTS

| | | | |
|---|---|---|---|
| 210880 | 9/1965 | Sweden | 292/225 |

*Primary Examiner*—Joseph J. Rolla
*Assistant Examiner*—Kevin P. Shaver
*Attorney, Agent, or Firm*—Woodling, Krost & Rust

[57] ABSTRACT

A drop-bottom box (11) which has a bottom wall (18) hingedly connected thereto and which is hooked up in closed position by hooks (30) engaging studs secured to the bottom wall, and which hooks (30) are biased to closed position but which may be released from locking position by a lever (32) biased to a closing position by springs (33).

2 Claims, 5 Drawing Figures

DROP-BOTTOM BOX

FIELD TO WHICH INVENTION RELATES

My invention relates to drop-bottom boxes used for holding and transporting material, generally of a nature which accommodates itself to the shape of the container, such as sand, rubble, metal scraps and material of various kinds usually placed in a hopper or other container for transportation from one location to another. The box has a bottom wall which supports the material when the bottom wall is in closed position and which swings downwardly for discharge of the material.

BACKGROUND ART OF THE INVENTION

The related background art known to Applicant, but which does not teach, disclose or suggest the present invention, includes U.S. Pat. No. 3,549,033 issued Dec. 22, 1970 to William E. Howard.

STATEMENT OF THE INVENTION

It is an object of the invention to provide an improved drop-bottom box of the character required for this purpose and which has a novel mechanism for locking the bottom wall in place and for unlocking the bottom wall when it is desired to discharge the material in the box.

Another object is the provision for improved safety in the transporting of material in a drop-bottom box during the time that the box is transported at an elevation from one location to another.

Another object is to improve the efficiency in the operation and construction of the mechanism which locks and unlocks the bottom wall from the box so as to facilitate the use of the box.

Another object is to combine maximum efficiency in the operation of a drop-bottom box and at the same time to maintain the maximum of safety in the use of such a box.

Other objects and advantages may be observed from the following description of the invention in conjunction with the several drawings.

FIGURES OF THE DRAWINGS

DESCRIPTION OF THE INVENTION HEREIN DISCLOSED

Figure 1:
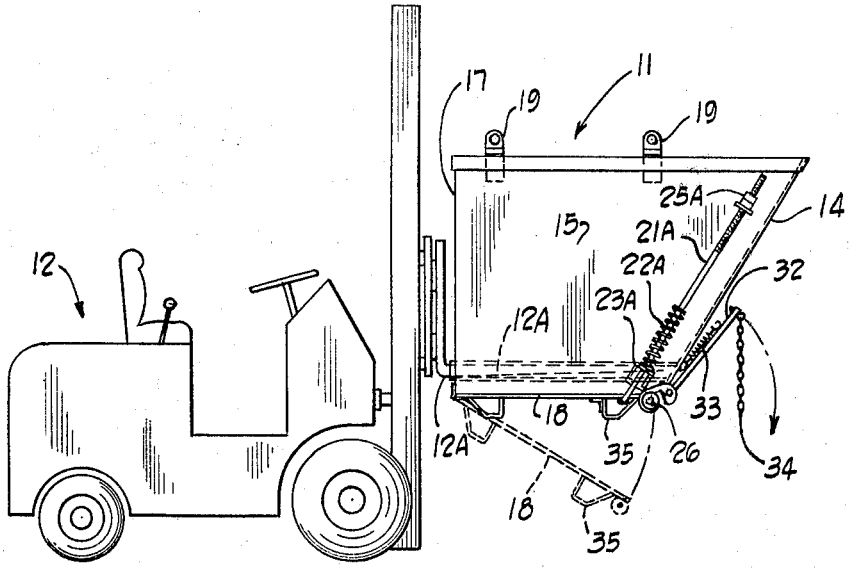
FIG. 1 is a side view of my improved drop-bottom box showing it at an elevated position as raised to that position by a lift truck.

In the drawings my improved drop-bottom box is denoted generally by the reference character 11. It may be raised to an elevated position such as shown in FIG. 1 by the fingers or forks 12A of a lift truck denoted generally by the reference character 12.

In like manner, my drop-bottom box may be raised to an elevated position by means of chains 13 suspended from a hoist, which chains are hooked to four lugs 19 welded at spaced locations to the upper portion of the box 11.

The box 11 is comprised of a forward inclined wall 14, two parallel side walls 15 and 16, and a rear wall 17. These four walls are joined together by welding to complete the surrounding walls of the box. A bottom wall 18 is hingedly connected by hinges 20 to the rear wall 17 at its lower portion thereof in such manner that the bottom wall 18 may swing upwardly to close the bottom opening formed by the four walls 14, 15, 16 and 17. The bottom wall 18 is shown in closed position by full lines in FIGS. 1 and 2 and in open position by the broken lines in FIGS. 1 and 2.

It is usually desirable to limit the downward inclination of the bottom wall 18 when opened for discharge of the material in the box. For this purpose, there are two limit rods 21A and 21B which are joined at the bottom ends by the transverse rod 21. The rod 21 with its portions 21A and 21B thus are in U-shape. The transverse portion of the rod 21 is mounted by four pivot mountings to the bottom wall 18 whereby the rods 21A and 21B may swing between the position shown in full lines and the position shown in broken lines in FIG. 2. There is thus a small amount of pivot action between the transverse rod 21 and the bottom wall 18 by means of the pivot mountings 24.

The effective length of the limit rods 21A and 21B is determined by adjusting nuts 25A and 25B on the upper threaded ends of the respective limit rods 21A and 21B.

Figure 2:
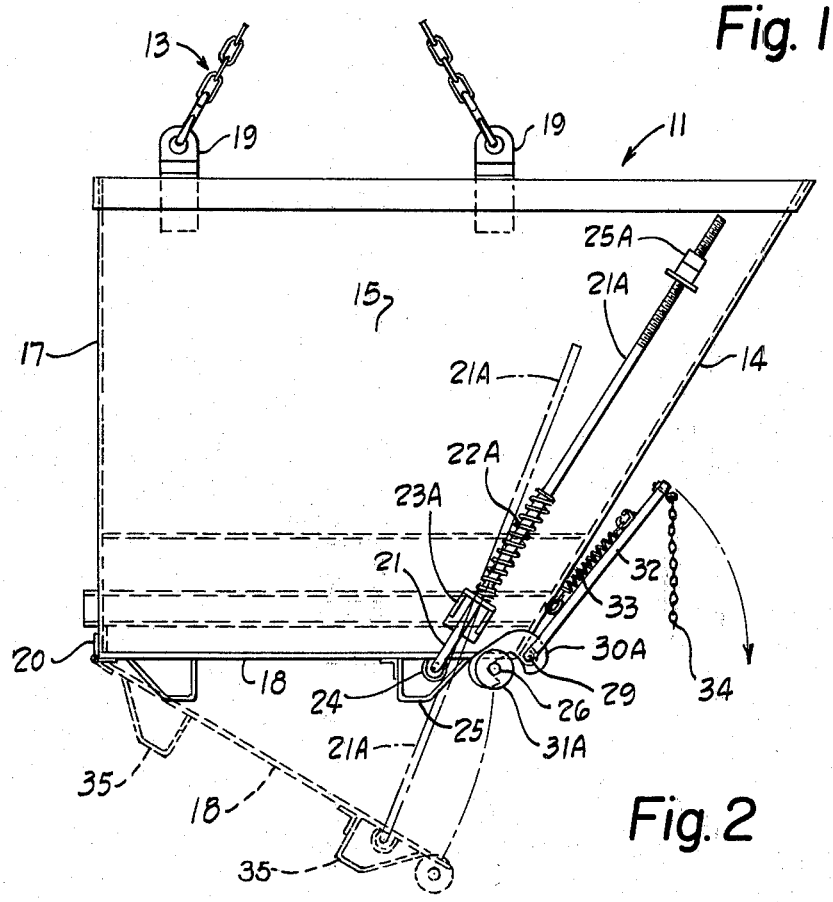
FIG. 2 is a similar side view of the drop-bottom box raised in an elevated position by means of chains suspended from a hoist.

A stop bracket 23A is fixedly secured, such as by welding, to side wall 15 of the box near the limit rod 21A and similarly a stop bracket 23B is fixedly mounted to the other side wall 16 of the box. Mounted on each limit rod 21A and 21B above the respective stop brackets is a compression spring in coil form identified as 22A and 22B. These coil springs are for the purpose of dampening or absorbing the shock when the bottom wall 18 is suddenly released and dropped to its downwardly inclined position. The stop nuts 25A and 25B on the ends of the limit rods 21A and 21B engage and compress the springs 22A and 22B when the bottom wall 18 is dropped. The coil spring thus absorbs the shock and dampens the sudden jolting that would otherwise occur. The openings in the stop brackets 23A and 23B are sufficiently large as to accommodate both the longitudinal movement of the limit rods 21A and 21B through the openings in the stop brackets 23A and 23B, as well as permitting the limit rods 21A and 21B to swing on the axis of the transverse rod 21 between its positions shown in full lines and in broken lines in FIG. 2. The several parts of the limit rods, coil spring and stop brackets are similar on both sides of the box. The parts on the right-hand side of the box, such as shown in FIGS. 1 and 2, have the letter A added to the reference character, whereas the parts on the left-hand side, have the letter B added to the similar reference character.

The bottom wall 18 has four legs 35 for supporting the box on base or ground surface when the box has been lowered to such a surface.

Figure 3:
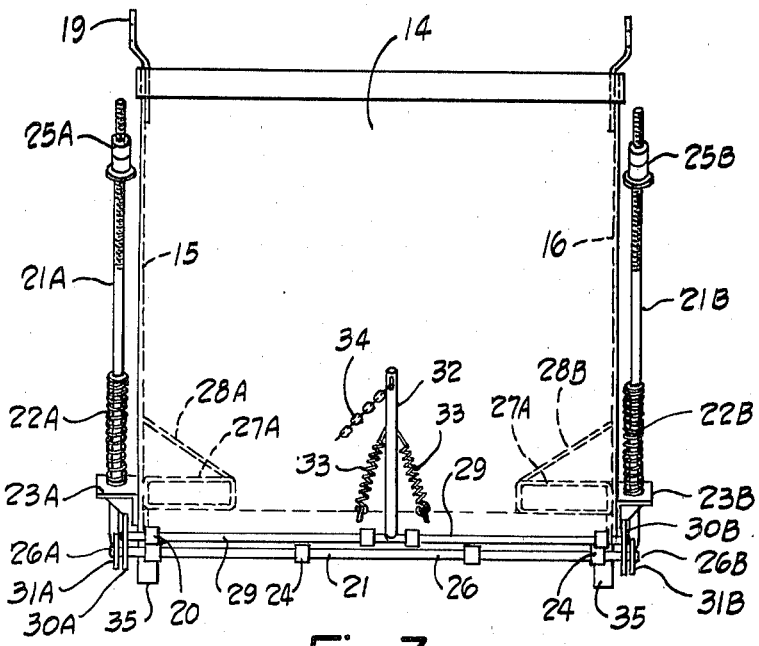
FIG. 3 is an end view looking toward the front inclined wall of my improved box.
Figure 5:
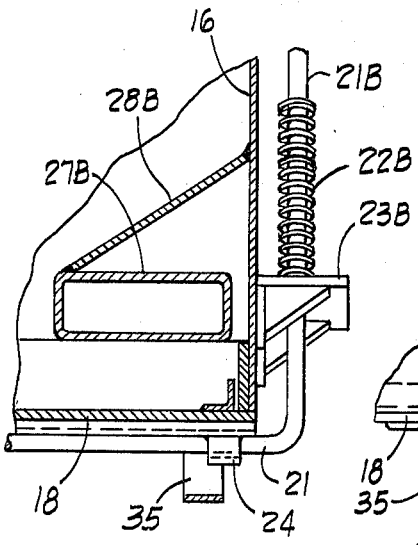
FIG. 5 is a cross-sectional view looking in the direction of the arrows 5—5 of FIG. 4.
Figure 4:
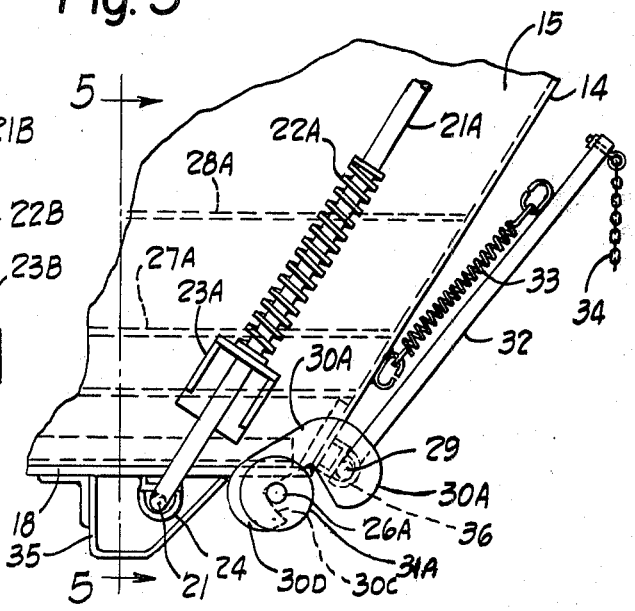
FIG. 4 is an enlarged view taken on one side of the drop-bottom box at the location of the locking and unlocking mechanism.

Pivotally mounted to the forward inclined wall 14 adjacent its bottom edge portion by means of mountings 36 is a transverse pivot shaft 29 which extends across the lateral extent of the box. The shaft 29 is thus carried by the box to permit some pivoting of the shaft 29 on its axis. Mounted by welding or other suitable means to the shaft 29 near its outer ends thereof are a pair of hooks 30A and 30B so that the hooks swing in parallel planes to each other upon the pivotal turning of the shaft 29. A lever 32 is welded or otherwise secured to the shaft 29 intermediate of the ends of the shaft 29. The lever 32 is inclined generally upwardly along the forward wall 14 of the box. A pair of tension springs 33, inclined toward each other as seen in FIG. 3, are anchored to both the lever 32 and the forward wall 14 as illustrated in FIG. 4. The tension of the springs 33 is such as to bias the lever 32 upwardly to its position shown in FIGS. 3 and 4. A flexible cable 34 is secured to the upper end of the lever 32 for facilitating the downward pull on the outer end of the lever 32. An operator pulling downwardly on the cable 34 swings the lever 32 downwardly against the bias of the springs 33 and thus pivots the pivot shaft 29. The pivoting of the shaft 29 on its axis in turn swings the hooks 30A and 30B in arcs about the axis of the pivot shaft 29.

Secured by welding or other suitable means to the bottom wall 18 near its forward portion adjacent the inclined wall 14 is a transverse rod 26, the outer end portions of which provide studs 26A and 26B. Mounted to the extreme outer ends of the transverse rod 26 are discs 31A and 31B which are so disposed as to guard the free ends of the hooks 30. The discs 31A and 31B are so spaced out along the ends of the rod 26 from the side walls 15 and 16 that there is a space between the side walls and the discs on the extreme outer ends of the rod 26. This space is sufficient to readily permit the hooks 30 to swing in their respective arcs to engage the rod 26 such as shown in FIGS. 3 and 4.

Each hook 30 has an inner arcuate bight surface 30C which is so inclined as to hookingly engage the studs on the ends of the rod 26 when the hooks are in their downward position as shown in FIG. 4.

At the lower outer surface of each hook 30 there is an arcuate surface 30D which is adapted to cammingly engage the studs on the ends of rod 26 when the hooks are raised and the box is being lowered so as to cause the arcuate surfaces 30D of the hooks to engage the studs and to thus cammingly swing the hooks upwardly sufficient enough to clear the studs. The hooks upon clearing the studs swing downwardly to cause the hooks to cammingly engage the studs to the position shown in FIG. 4. The bias of the springs 33 is such as to induce the hooks to swing downwardly after they have cleared the studs and to thus permit the hooks to engage the studs whereby the studs are engaging the inner arcuate surface 30C of the hooks.

In the use of my box when it is desired to load the box, it is lowered to the ground or other supporting surface. When thus lowered, the hook members automatically engage and hook the studs formed on the outer ends of the transverse rod 26. The bottom wall 18 is thus held firmly in locked position to the other walls of the box so that material may be placed in the box and supported on the bottom wall. The box is then raised and transported by either a lift truck or a hoist to a location where it is desired to discharge the contents of the box. The operator then pulls on the flexible cable 34 so as to swing the lever 32 downwardly away from the rear wall 17. This causes the hooks to be raised upwardly so as to clear the studs. Upon the studs being released from the hooks, the bottom wall is no longer restrained or held in closed position but swings downwardly at an angle to the limit permitted by the limit rods and this downward swinging has its shock dampened by the coil springs. As readily seen, the degree of inclination of the bottom wall when released is determined by the effective length of the limit rods 21A and 21B. After the contents have been discharged, the box is lowered to where the hooks are raised by the engagement with the studs so as to clear the studs and the hooks then automatically hookingly engage the studs by means of the tension of the springs 33.

To accommodate the fingers or forks of a fork lift, there is provided within the box a pair of spaced pockets or slots 27A and 27B. Inclined baffles 28A and 28B extend over these pockets so that the contents within the box tend to slide or fall downwardly and inwardly away from these pockets.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. In a drop-bottom box having side walls defining a space between them for accommodating material and a bottom wall being hingedly connected to a first said side wall of the box, said bottom wall upon being swung upwardly to the level of the lower portions of said side walls retaining the material in the box, the improvement comprising a pair of hook members carried by the box at a distance from, and opposite of, said first side wall, said hook members being swingable on a common axis in parallel arcs, a pair of stud members carried by said bottom wall and extending laterally outwardly therefrom on opposite sides of the box at a distance from said first wall in positions to be engaged by, and held in the bight of, said hook members, a rod operatively connecting said hook members to cause the hook members to swing in unison on said common axis in parallel arcs, an actuating member connected to said rod to rotate the same and to swing said hook members, the said box being adapted to be lowered to rest upon a supporting surface and to be raised at an elevation above said supporting surface, the said hook members having outer arcuate surfaces engageable by said stud members upon the box being lowered toward the supporting surface, and to cammingly swing the hook members in their respective arcs to hookingly engage the said stud members, the stud members hookingly engaged in said hook members holding said bottom wall up to the level of the lower portions of side walls to retain material in the box, actuation of said actuating member to swing said hook members to disengage said stud members upon the raising of the box above said supporting surface permitting said bottom wall to swing downwardly to permit material in the box to fall therefrom, and engaging means mounted on the outboard ends of said stud members for engaging the said supporting surface upon lowering of the box and guarding said hook members against engagement with said supporting surface.

2. In a drop-bottom box having side walls and a bottom wall hingedly connected to one of said side walls, the improvement of hook members disposed outwardly of opposite side walls and carried by opposite said one side wall of the box, said hook members swingable together in parallel arcs on a common axis in planes parallel to, and outwardly of the planes of said opposite side walls, stud members carried by said bottom wall at a distance from said one side wall and in position to be engaged by said hook members, respectively, said hook members having an outer arcuate surface engageable by said stud members, respectively, to swing the hook members to clear the stud members upon downward movement of the hook members on the said opposite side walls toward the stud members, said hook members being biased to swing back and to hookingly engage said stud members upon clearing of the stud members during said downward movement of the hook members, actuating means for concurrently swinging both said hook members to disengage and release the said stud members, and engaging means mounted on the outboard ends of said stud members for engaging a supporting surface upon lowering of the box and guarding said hook members against engagement with said supporting surface.

* * * * *